United States Patent [19]

De Matthaeis et al.

[11] Patent Number: 4,952,121

[45] Date of Patent: Aug. 28, 1990

[54] RADIAL PISTON PUMP WITH MEANS PREVENTING OVALIZATION OF PISTON CHAMBER

[75] Inventors: Sisto L. De Matthaeis, Modugno; Mario Ricco, Bari; Alessandro Valetto, Turin, all of Italy

[73] Assignee: Weber S.r.l., Turin, Italy

[21] Appl. No.: 236,452

[22] Filed: Aug. 25, 1988

[30] Foreign Application Priority Data

Aug. 25, 1987 [IT] Italy ..... 53609/87[U]

[51] Int. Cl.[5] ..... F04B 1/04

[52] U.S. Cl. ..... 417/273; 417/360; 417/572; 92/161

[58] Field of Search ..... 417/273, 572, 360; 91/491; 92/161, 169.1

[56] References Cited

U.S. PATENT DOCUMENTS

| | | | |
|---|---|---|---|
| 2,469,998 | 5/1949 | Smith | 417/454 |
| 2,825,289 | 3/1958 | Palmer | 417/454 |
| 4,105,371 | 8/1978 | Savage et al. | 417/273 X |
| 4,151,786 | 5/1979 | Hockensmith | 92/117 R |
| 4,681,514 | 7/1987 | Griese et al. | 417/273 X |
| 4,700,616 | 10/1987 | Stoll et al. | 92/161 X |
| 4,768,606 | 9/1988 | Abels et al. | 92/161 X |
| 4,776,768 | 10/1988 | Kondoh | 417/273 X |

FOREIGN PATENT DOCUMENTS 2415884 10/1975 Fed. Rep. of Germany .

*Primary Examiner*—Leonard E. Smith

[57] ABSTRACT

The pump comprises a plurality of cylinders (4) disposed radially in a star formation around a shaft (5) with an eccentric (6) in a body (2, 3) formed by first and second members (2, 3) joined together by bolts (13). Each cylinder (4) is clamped in position between the first and second elements (2, 3) of the body between a pair of the said bolts (13). The facing surfaces of each cylinder (4) and of at least one (3) of the members (2, 3) of the pump body are spaced in correspondence with the central portion of the cylinder (4) in which is formed the chamber (9) in which the associated piston (10) is movable, so that the contact between the cylinder (4) and the at least one member (3) of the body (2, 3) of the pump is limited to surfaces outside the central portion of the cylinder (4).

3 Claims, 3 Drawing Sheets

1
2
3
4
4a
5
6
7
8
9
10
10a
11
12
13
14
III
III

RADIAL PISTON PUMP WITH MEANS PREVENTING OVALIZATION OF PISTON CHAMBER

The present invention relates to a radial piston pump, particularly an injection pump for diesel engines, of the type comprising a plurality of cylinders disposed radially in a star formation around a shaft with an eccentric in a body formed by first and second members, a casing and a lid respectively, joined together by means of a plurality of axial clamping members, each cylinder being clamped in position between the clamped first and second members between a pair of the said clamping members.

A radial piston pump of this type is described, for example, in German Patent No. 3312970. In this pump, the clamping members are constituted by threaded rods (stud bolts). The effect of the clamping of the cylinders by means of these members can cause the chamber in which the piston associated with each cylinder is movable to be squashed (ovalized) ever so slightly, with the consequent possibility of fluid leakage and a risk of jamming.

The object of the present invention is to provide a radial piston pump which enables these disadvantages to be overcome.

This object is achieved according to the invention by means of a pump of the type specified above, characterised in that the facing surfaces of each cylinder and of at least one of the members of the pump body are spaced in correspondence with the central portion of the cylinder in which is formed the chamber in which the associated piston is movable, so that the contacts between the cylinder and the at least one member of the body of the pump is limited to surfaces outside the central portion of the cylinder.

Further characteristics and advantages of the present invention will become apparent from the detailed description which follows with reference to the appended drawings, provided purely by way of non-limiting example, in which.

Figure 1:
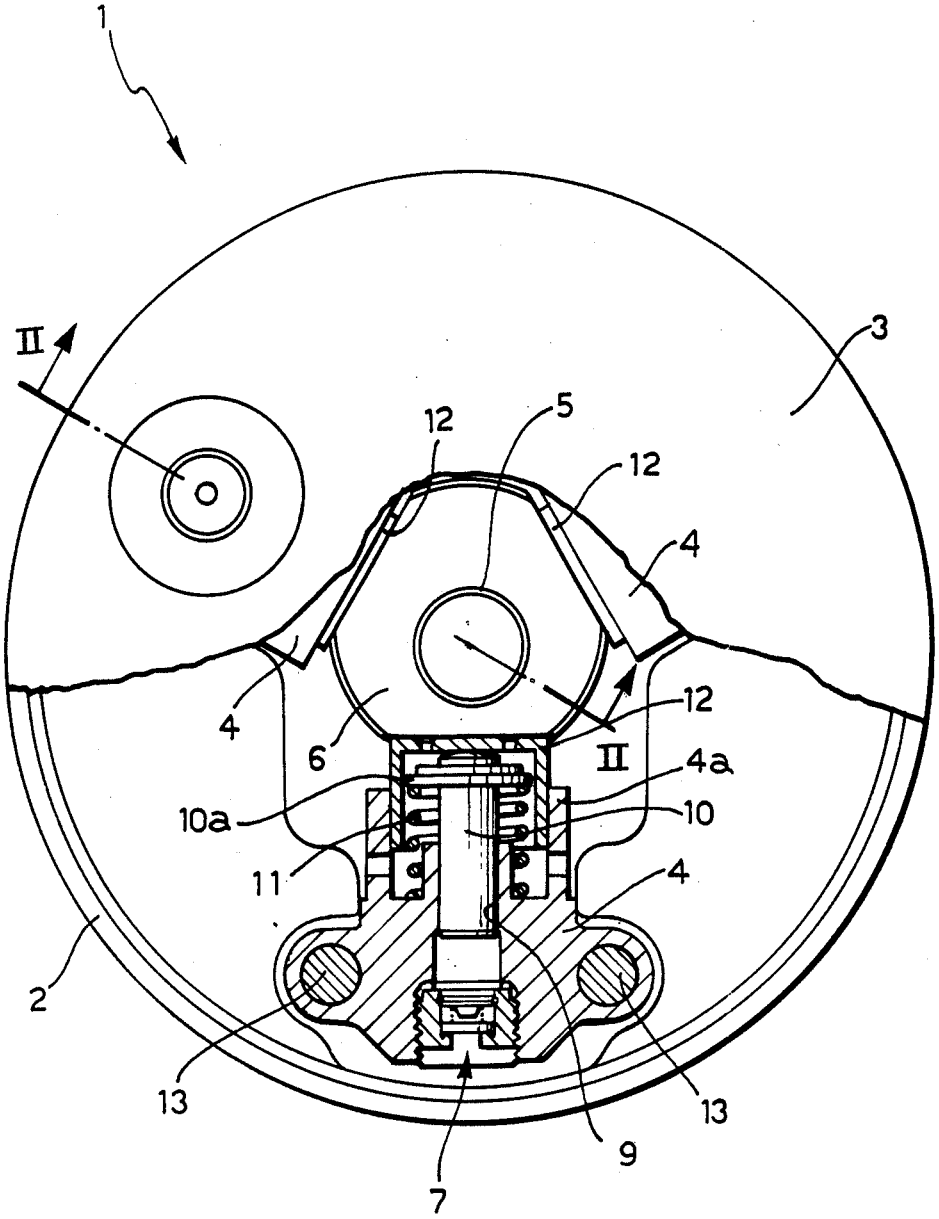
FIG. 1 is a partially-sectioned view of a radial piston pump according to the invention.

With reference to the drawings, a radial piston pump 1 according to the present invention includes a body formed by a hollow member or casing 2 to which is sealed a second member or lid, indicated 3. Three cylinders 4 disposed radially in a star formation around a shaft 5 carrying an eccentric 6 are mounted in this body.

In known manner, each cylinder 4 is associated with an intake valve and a delivery valve, generally indicated 7 and 8, respectively.

A respective cylindrical chamber 9 is formed in each cylinder 4 with its axis extending radially of the shaft 5. A piston 10 is slidable in each chamber and has a radial projection 10*a* at its end facing the eccentric 6.

Each piston 10 has an associated helical spring 11 which acts at one end against the corresponding cylinder 4 and at the other end against the projection 10*a* of the piston, urging the latter towards the eccentric 6.

At its end facing the eccentric, each cylinder 4 has a cylindrical extension 4a essentially in the form of a skirt surrounding the associated piston.

Three cup-shaped members are indicated 12, each of which is interposed between a piston 10 and the surface of the eccentric 6. Each cup-shaped member 12 has its lateral portion mounted slidably in the extension skirt 4*a* of a cylinder.

In operation, the cup-shaped members 12 discharge the tangential forces exerted by the eccentric 6 on the skirt portions 4*a* of the cylinders 4, effectively transferring to the pistons 10 only a force axially of the pistons. The friction between the pistons and the cylinders and the noise generated in operation are thus reduced.

Figures 2, 3:
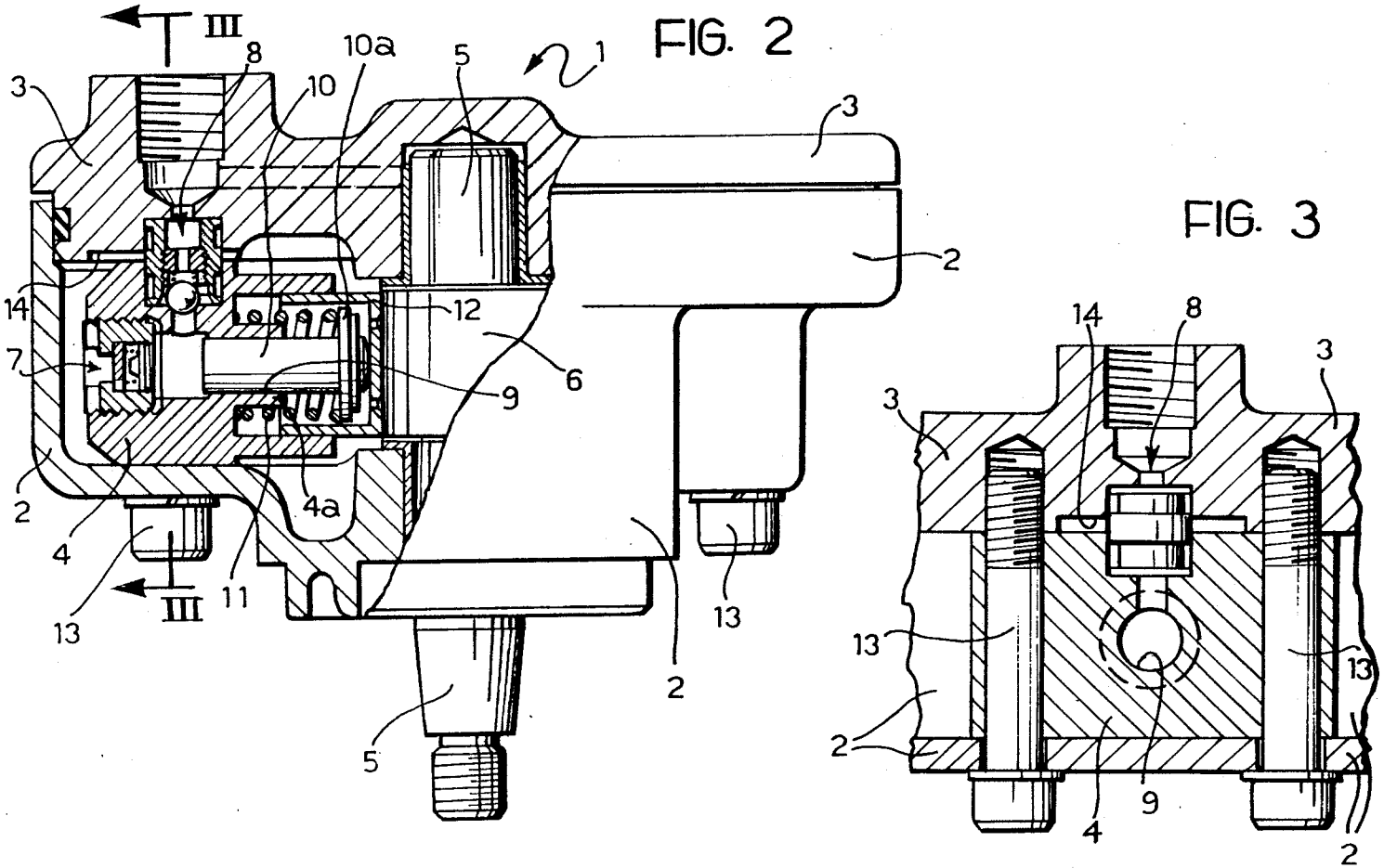
FIG. 2 is a partially-sectioned view taken on the line II—II of FIG. 1.
FIG. 3 is a partial sectional view taken on the line III—III of FIG. 2.

Each cylinder is clamped in position by the clamping of the casing 2 and the lid 3 by means of three pairs of stud bolts, indicated 13. As is particularly apparent from a study of FIGS. 1 and 3, the surface of each cylinder 4 facing the lid 3 is spaced from the corresponding surface portion of the lid, in correspondence with the central portion in which the chamber 9 is formed. This may be achieved, for example, by the provision of a recess in the lid 3, such as that indicated 14 in FIGS. 2 and 3, in correspondence with each cylinder 4.

Figure 4:
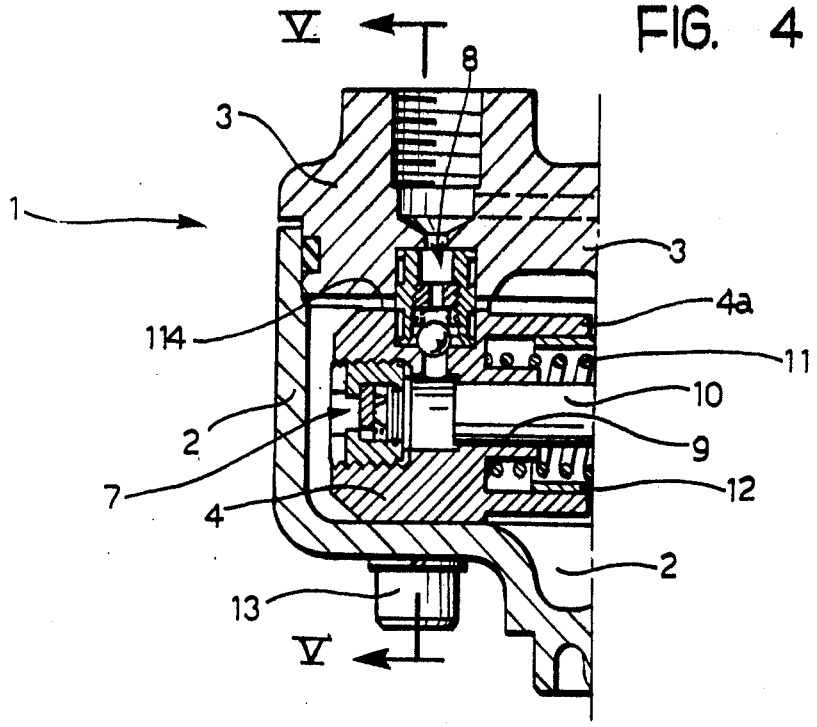
FIG. 4 is a partial sectional view, similar to the view shown in FIG. 2, of another pump according to the invention.
Figure 5:
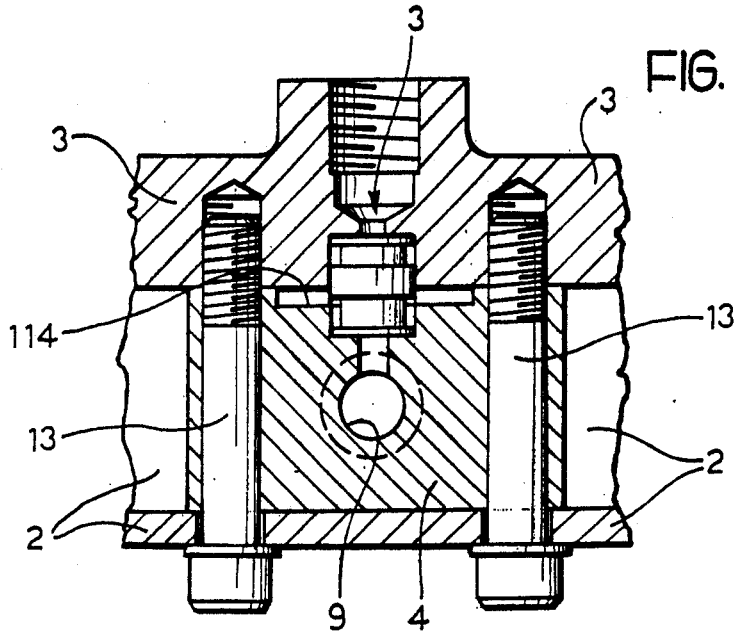
FIG. 5 is a partial sectional view taken on the line IV—IV of FIG. 4.

Alternatively, the spacing of the central portion of each cylinder 4 from the facing surface portion of the lid 3 may be achieved by the provision of a recess in each cylinder, such as that indicated 114 in FIGS. 4 and 5.

The spacing between the central portion of the surface of each cylinder facing the lid 3 and the corresponding surface portion of the lid may clearly be achieved by by provision of recesses in both the cylinder and the lid.

In each case, the cylinder 4 and the lid 3 are in limited contact in correspondence with surfaces of the cylinder outside the portion thereof in which the chamber 9 is formed. Consequently, any risk of squashing (ovalization) of the chamber 9 due to the clamping of the bolts 13 is avoided.

The spacing of the central portion of the surface of the cylinder facing the base wall of the casing 2 from this base wall may be achieved in a similar way (in a manner not illustrated).

We claim:

1. A radial piston pump comprising a plurality of cylinders disposed radially in a star formation around a shaft with an eccentric in a body formed by first and second members, a casing and a lid respectively, joined together by means of a plurality of axial clamping members, each cylinder being clamped in position between the clamped first and second members of the body between a pair of said clamping member, facing surfaces of each cylinder and of at least one of the member of the pump body being spaced in correspondence with the central postion of the cylinder in which is formed a chamber in whcih an associated piston is movable, at least one surface of each cylinder facing a member of the body having a recess or central reba e in correspondence with the portion of the cylinder in which the chamber is formed, so that contact between the cylinder and the at least one member of the body of the pump is limited to surfaces outside the central portion fo the cylinder.

2. A radial piston pump according to claim 1, wherein the portions of the surface of at least one member of the body facing the cylinders have respective recesses each of which faces a portion fo the associated cylinder in which the chamber is formed.

3. A radial piston pump according to claim 1, wherein each cylinder has lateral apendages located on opposite sides of the axis of the chamber through which the clamping members extend.

* * * * *